US005791306A

United States Patent [19]

Williamson

[11] Patent Number: 5,791,306

[45] Date of Patent: Aug. 11, 1998

[54] INTERNAL COMBUSTION ENGINE SPEED-THROTTLE CONTROL

[75] Inventor: Jack R. Williamson, East Peoria, Ill.

[73] Assignee: Caterpillar Inc., Peoria, Ill.

[21] Appl. No.: 910,651

[22] Filed: Aug. 13, 1997

[51] Int. Cl.[6] ..... F01L 13/00

[52] U.S. Cl. ..... 123/90.16; 123/90.41

[58] Field of Search ..... 123/90.15, 90.16, 123/90.39, 90.41, 90.42

[56] References Cited

U.S. PATENT DOCUMENTS

| | | | |
|---|---|---|---|
| 2,410,660 | 11/1946 | Howard | 123/90.16 |
| 2,887,993 | 5/1959 | Shallenberg | 123/301 |
| 3,261,338 | 7/1966 | Arutunoff et al. | 123/90.15 |
| 3,413,965 | 12/1968 | Gavasso | 123/90.16 |
| 3,722,484 | 3/1973 | Gordini | 123/90.27 |
| 4,397,270 | 8/1983 | Aoyama | 123/90.16 |
| 4,572,118 | 2/1986 | Baguena | 123/90.16 |
| 4,721,007 | 1/1988 | Entzminger | 123/90.16 |
| 4,723,515 | 2/1988 | Burandt | 123/90.16 |
| 4,829,949 | 5/1989 | Holmer | 123/90.39 |
| 4,898,130 | 2/1990 | Parsons | 123/90.16 |
| 4,911,124 | 3/1990 | Bennett | 123/321 |
| 4,986,227 | 1/1991 | Dewey, III | 123/90.41 |
| 5,016,581 | 5/1991 | Parsons | 123/90.25 |
| 5,197,447 | 3/1993 | Dick | 123/90.16 |
| 5,365,895 | 11/1994 | Riley | 123/90.16 |
| 5,456,224 | 10/1995 | Riley | 123/90.16 |
| 5,572,962 | 11/1996 | Riley | 123/90.16 |

*Primary Examiner*—Wellun Lo
*Attorney, Agent, or Firm*—Fred J. Baehr

[57] ABSTRACT

A double wheel roller 31 and a pair of outboard rollers 35 are positioned, respectively, along a pair of parallel tracks 25 disposed on a rocker arm 15 and a pair of parallel rails 37 disposed on a pair of support plates 39 disposed on opposite sides of the rocker arm 15, a control rod 49 is utilized to move the rollers 31 and 35 along the tracks 25 and rails 37 to vary the pivot point of the rocker arm 15, and thus vary the lift of an intake valve 7 or the amount the valve 7 opens and vary the amount of combustion air admitted to the cylinder 4, which cooperates with the amount and timing of fuel injected into the cylinder 4 and the timing of the spark to control the speed and power output of a fuel injection, spark ignition, engine 2.

11 Claims, 2 Drawing Sheets

INTERNAL COMBUSTION ENGINE SPEED-THROTTLE CONTROL

TECHNICAL FIELD

Figure 1:
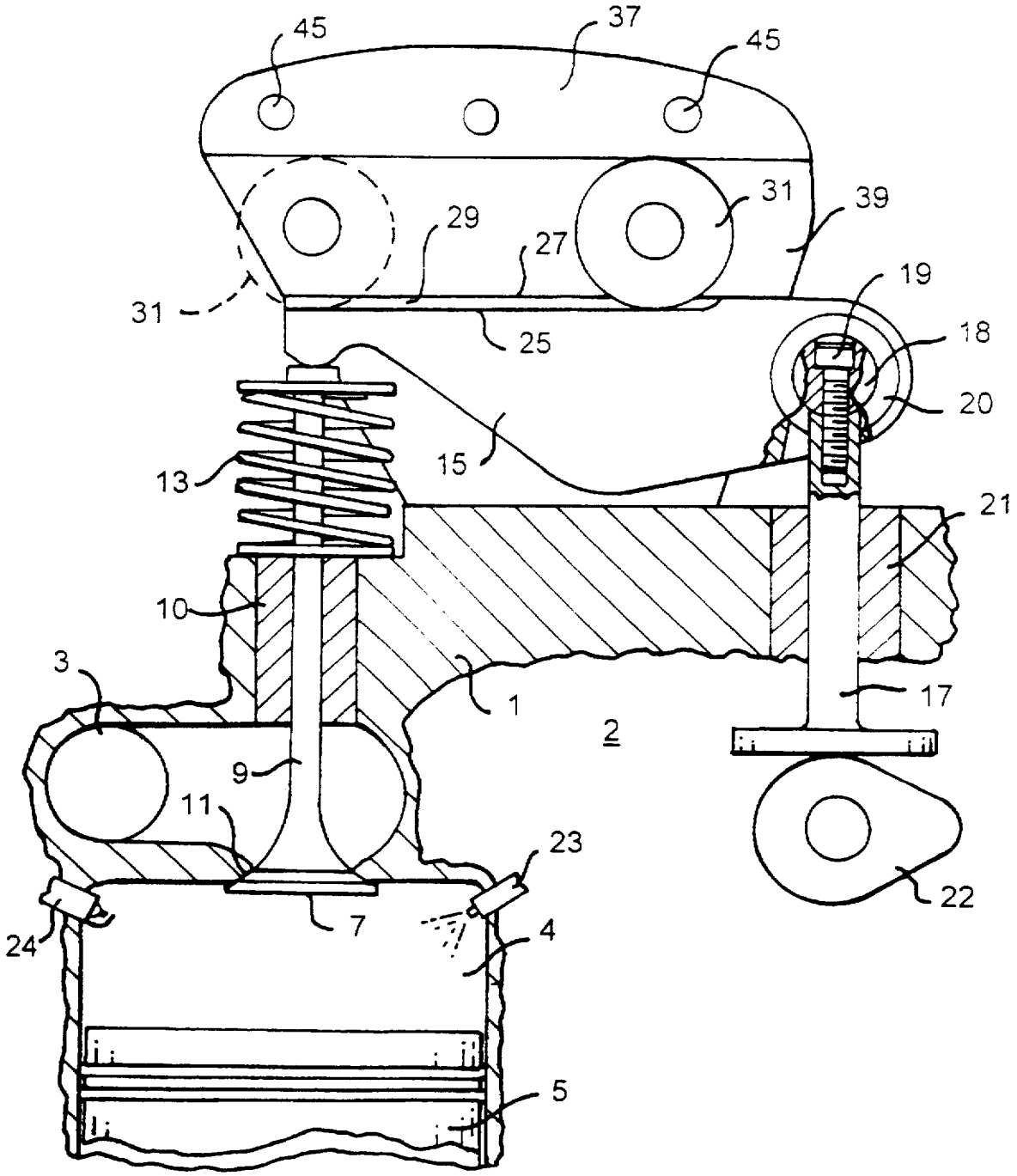

The invention relates to an internal combustion engine and more particularly to such an engine having variable intake valve lift, which controls the amount of combustion air supplied to the cylinders and cooperates with the amount fuel injected into the cylinder to control the engine speed replacing the traditional carburetor.

BACKGROUND ART

Internal combustion engines generally utilize a valve operating mechanism constructed to control the opening and closing of the intake and exhaust valves which are fixed for operating the engine to meet the requirements for the designed speed and load. At partial loads and low speed a throttle valve restricts the airflow to reduce the air intake, causing a vacuum in the inlet manifold pulling oil through the valve guides. Many of the devices for varying valve lift such as those shown in U.S. Pat. No. 4,911,124 have interacting parts with sliding contact.

DISCLOSURE OF THE INVENTION

Among the objects of the invention may be noted the provision of a variable lift valve mechanism which reduces valve guide wear, reduces seating velocity at part load to reduce wear on the valve seat, provide instant intake air response, and because of reduced inlet manifold vacuum pulls less lubricating oil through the valve guides.

In general, an internal combustion engine speed—throttle control, when made in accordance with this invention, comprises an internal combustion engine having a cam, which is rotated by the engine to move a lifter rod up and down with each rotation and a mechanism for varying the lift of a valve disposed between a manifold and a cylinder. The mechanism is characterized by a rocker arm pivotally connected to the lifter rod. The rocker arm has a pair of parallel tracks disposed adjacent upper margins of the rocker arm. Disposed between the parallel tracks is an elongated hump. The hump comprises a pair of inwardly inclined planar surfaces. A double wheel roller is disposed to engage each of the parallel tracks and has a pair of frustoconical surfaces, a portion of which is disposed adjacent the inclined planar surfaces to prevent the rocker arm from rotating. A pair of outboard rollers is disposed to rotate independently about the same axis of rotation as the double wheel roller. A pair of parallel support rails is disposed in rolling contact with the outboard rollers and above the outboard rollers. A valve opening control rod is attached to the rollers in such a manner that it allows the rollers to roll along the parallel tracks and rails as the control rod moves generally longitudinally with respect to the to the parallel rails, thereby changing the position of the rocker arm pivot point and varying the valve lift, to control the fluid flow between the manifold and cylinder and cooperated with the amount of fuel injected to control the speed and power output of the engine.

DISCLOSURE OF THE DRAWINGS

Figure 2:
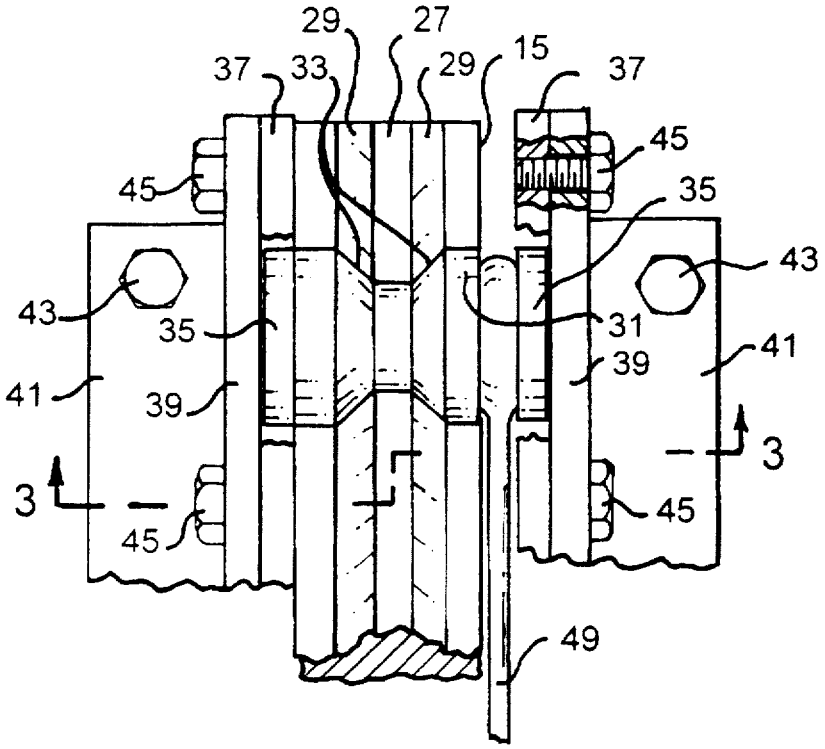
Figure 3:
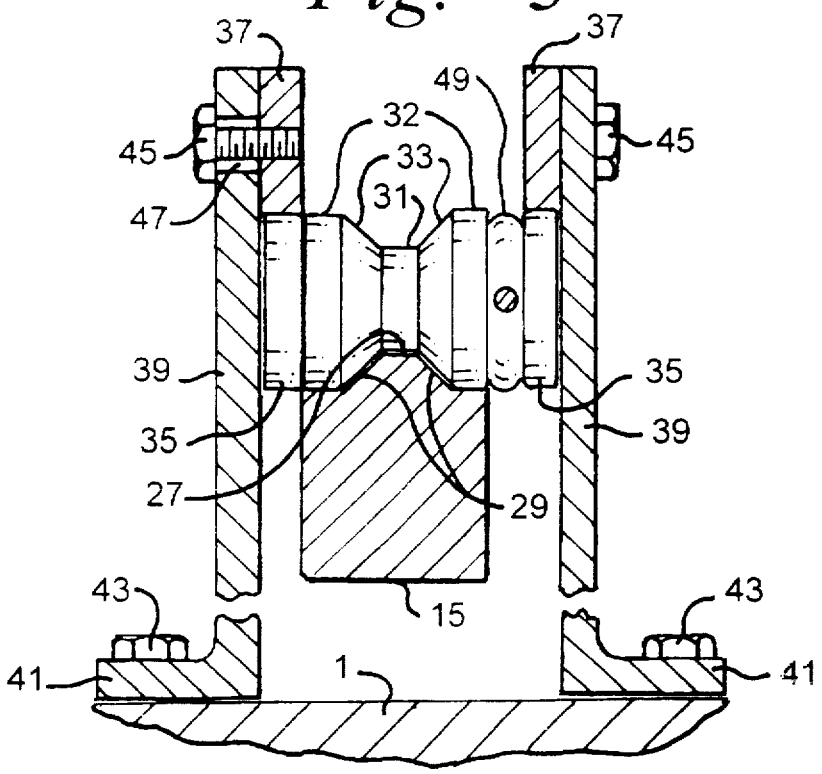

The invention as set forth in the claims will become more apparent by reading the following detailed description in conjunction with the accompanying drawings, wherein like reference numerals refer to like parts throughout the drawings and in which:

FIG. 1 is an elevational view, partially in section, of a variable valve lifting mechanism disposed in an internal combustion made in accordance with this invention, FIG. 2 is a partial plan view of the valve lifting mechanism showing some portions in section, and FIG. 3 is a sectional view taken on line A—A of FIG. 2.

BEST MODE FOR CARRYING OUT THE INVENTION

Referring now to the drawings in detail and in particular to FIG. 1, there is shown a portion of a block 1 of an internal combustion engine 2 comprising an inlet air manifold 3, one or more cylinders 4 having a piston 5 and a valve 7 with a valve stem 9 slidably disposed in a valve guide 10. The valve 7 is held against a seat 11 by a spring 13. A rocker arm 15 engages the stem 9 and is pivotally connected to a push or lifter rod 17 by a pin 18 fastened to the lifter rod 17 by a bolt 19. The rocker arm 15 has a bushing 20 disposed in one end to receive the pin 18. The lifter rod 17 is slidably disposed in a lifter rod guide 21 and the lower end of the lifter rod 17 engages a cam 22, which raises and lowers the lifter or push rod 17 each time the cam 22 is rotated by the engine 2.

A fuel injector 23 and spark plug 24 are disposed in the top of the cylinder 4 adjacent the valve 7.

Referring now in detail to FIGS. 2 and 3, the rocker arm 15 has a pair of parallel tracks 25 disposed adjacent upper margins of the rocker arm 15. Disposed between the parallel tracks 25 is an elongated hump 27, which generally extends the length of the tracks 25. The elongated hump comprises a pair of pair of inwardly inclined planar surfaces 29.

A double wheel roller 31 has a wheel portion 32 on each side thereof disposed to engage one of the parallel tracks 25. The double wheel roller also has a pair of frustoconical surfaces 33, a portion of which is disposed adjacent the inclined planar surfaces 29 to prevent the rocker arm 15 and lifter rod 17 from rotation about the longitudinal axis of the lifter rod 17. The width of the parallel tracks 25 is slightly wider than the width of the wheel portions 32 of the double wheel roller 31. There is a small clearance between the pair of inclined planar surfaces 29 on the rocker arm 15 and the frustoconical surfaces 33 on the double wheel rollers 31.

A pair of outboard rollers 35 are disposed outboard of the double wheel roller 31 to rotate about the same axis of rotation as the double wheel roller 31. A pair of parallel support rails 37 is disposed generally parallel to a top planar surface on the block 1, above, and in rolling contact with the with the outboard rollers 35. The width of the parallel support rails 37 is about equal or slightly wider than the width of the outboard rollers 35.

A pair of support plates 39 each have a flange portion 41, which is fastened to a block portion 1 of the engine 2 on opposite sides of the rocker arm 15 with bolts 43 or other fastening means. The parallel rails 37 are fastened to the support plates 39 by bolts 45 and the support plates 39 have a plurality of slotted holes 47, which receives the bolts 45, allowing the parallel rails 37 to be adjusted with respect to the support plates 39. This could be reversed with slots in the support rails 37 or shims (not shown) could be placed under the support plates.

A valve opening control rod 49 is cooperatively associated with the rollers 31 and 35 so as to allow the rollers 31 and 35 to rotate as the control rod 49 is moved generally longitudinally with respect to the parallel rails 37. Since the double wheel roller 31 rolls on top of the parallel tracks 25 and the outboard rollers roll below the support rails 37, as the control rod 49 moves the rollers 31 and 35 rotate in opposite directions.

As the valve opening control rod 49 moves generally longitudinally with respect the parallel rails 37, the position of the double wheel roller 31 and the outboard rollers 35 is changed. When the position of the double wheel roller 31 and outboard rollers 35 are in their nearest to the lifter rod 17 position and the cam 22 has fully lifted the lifter rod 17, the valve 7 is wide open. When the control rod 49 has positioned the double wheel roller 31 and outboard rollers 35 in their nearest to the valve stem 9 position and the cam 22 has fully lifted the lifter rod 17, the valve 7 is essentially closed.

Thus, the valve control rod 49 can position the double wheel roller 31 and outboard rollers 35 at any position between the extremes noted above to control how wide the valve 7 is opened and the amount of combustion air supplied to the cylinder 4 from the inlet air manifold 3 as the piston 5 moves downwardly. The amount of combustion air entering the cylinder 4 cooperates with the amount and timing of fuel injected and the timing of the spark to control the speed and power output of the fuel injection spark ignition engine 2. This variable valve lift mechanism may also be utilized on compression ignition engines. If this mechanism were utilized on exhausts valve in such engines, it could provide some dynamic braking.

While the preferred embodiments described herein set forth the best mode to practice this invention presently contemplated by the inventor, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

Industrial Applicability

Varying the lift of the intake valve 7 to control engine speed in place of a traditional carburetor type air control utilized in spark ignition engines 2 varies the intake valve lift to control the amount of air allowed to enter the cylinder 4 will advantageously reduce valve guide wear as the valve stem moment is reduced at part load and low speed, will reduce seating velocity and wear on the valve 7 and seat 11 at part load, will provide instant throttle response as there need not be a wait to fill the manifold 3 with air, will prevent oil from being pulled through the valve guides 10 as there is no vacuum in the manifold 3, and will do away with flame arrestors as fuel is injected into the cylinder 4 at the valve port area.

What is claimed is:

1. An internal combustion engine (2) having a cam (22), which is rotated by the engine (2) and moves a lifter rod (17) up and down with each cam (22) rotation and a mechanism for varying the lift of a valve (7) disposed between a manifold (3) and a cylinder (4) characterized by a rocker arm (15) pivotally connected to the lifter rod (17), the rocker arm (15) having a pair of parallel tracks (25) disposed adjacent upper margins of the rocker arm (15), disposed between the parallel tracks (25) is an elongated hump (27) comprising a pair of inwardly inclined planar surfaces (29), a double wheel roller (31) is disposed to engage the parallel tracks (25) and has a pair of frustoconical surfaces (33), a portion of which is disposed adjacent the inclined planar surfaces (29) to prevent the rocker arm (15) and lifter rod (17) from rotating, a valve opening control rod (49) cooperatively associated with the double wheel roller (31) so as to allow the double wheel roller (31) to rotate as the control rod (49) moves generally longitudinally to change the position of the double wheel roller (31) along the parallel tracks (25) and thereby change the rocker arm pivot point and vary the valve lift to control the quantity of fluid flowing between the manifold (3) and the cylinder (4) to control the engine speed.

2. The internal combustion engine (2) as set forth in claim 1 further characterized by a pair of outboard rollers (35) disposed to rotate independently about the same axis of rotation as the double wheel roller (31), a pair of parallel support rails (37) disposed in rolling contact with the outboard rollers (35), and above the outboard rollers (35).

3. The internal combustion engine (2) as set forth in claim 2 further characterized by the double wheel roller (31) and the outboard rollers (35) having generally the same outside diameter.

4. The internal combustion engine (2) as set forth in claim 3 further characterized by width of the parallel tracks (25) being generally equal to the width of the parallel rails (37).

5. The internal combustion engine (2) as set forth in claim 4 further characterized by the width of the wheels (32) of the double wheel roller (31) being generally equal in width to the outboard rollers (35).

6. The internal combustion engine (2) as set forth in claim 5, further characterized by a pair of support plates (39) disposed on opposite sides of the rocker arm (15) for supporting the parallel rails (37) upon which the outboard rollers (35) roll.

7. The internal combustion engine (2) as set forth in claim 6, further characterized by the parallel rails (37) being fastened to the support plates (39) by bolts (45) and slotted holes (47) receive the bolts (45) to allow the parallel rails (37) to be adjusted with respect to the support plates (39).

8. The internal combustion engine (2) as set forth in claim 7, further characterized in that the lifter rod (17) is fastened to a pin (18) and the rocker arm (15) has a bushing (20) disposed adjacent one end for receiving the pin (18).

9. The internal combustion engine (2) as set forth in claim 8, further characterized in that when the valve opening control rod (49) has positioned the double wheel roller (31) in its nearest to the lifter rod (17) position, the valve (7) will open fully.

10. The internal combustion engine (2) as set forth in claim 9, further characterized in that when the valve opening control rod (49) has positioned the double wheel roller (31) in its nearest to the valve position, the valve (7) remains essentially closed.

11. The internal combustion engine as set forth in claim 8, further characterized in that when the valve opening control rod (49) changes the position of the double wheel roller (31), the amount the valve (7) opens changes.

* * * * *